US006478917B1

(12) United States Patent
Magoni et al.

(10) Patent No.: US 6,478,917 B1
(45) Date of Patent: Nov. 12, 2002

(54) PROCESS FOR MANUFACTURING A SKI OR LIKE BOARD FOR GLIDING OVER SNOW

(76) Inventors: Fabrice Magoni, 5 Rue Molière, 38500 Voiron (FR); Henri-Charles Deborde, Le Bernardin, 38850 Bilieu (FR)

( * ) Notice: Subject to any disclaimer, the term of this patent is extended or adjusted under 35 U.S.C. 154(b) by 0 days.

(21) Appl. No.: 09/353,119

(22) Filed: Jul. 14, 1999

(30) Foreign Application Priority Data

Jul. 17, 1998 (FR) ..... 98 09322

(51) Int. Cl.[7] ..... A63C 5/14
(52) U.S. Cl. ..... 156/245; 156/298; 156/221
(58) Field of Search ..... 280/601, 610, 280/608, 607, 609; 441/68; 156/79, 182, 245, 298, 219, 220, 221, 222

(56) References Cited

U.S. PATENT DOCUMENTS 3,628,802 A * 12/1971 Hashimoto et al. ... 280/11.13 L
3,967,992 A * 7/1976 McCaskey, Jr. et al. ..... 156/85
4,679,814 A * 7/1987 Meatto et al. ..... 280/610
5,169,170 A * 12/1992 Hayashi ..... 280/610
5,230,844 A * 7/1993 Macaire et al. ..... 264/46.7
5,294,139 A * 3/1994 Cazaillon et al. ..... 280/610
5,591,509 A * 1/1997 Lorenz et al. ..... 428/107

* cited by examiner

*Primary Examiner*—Jeff H. Aftergut
*Assistant Examiner*—Gladys Piazza
(74) *Attorney, Agent, or Firm*—Hselin Rothenberg Farley & Mesiti P.C.; Philip E. Hansen; Victor A. Cardona, Esq.

(57) ABSTRACT

This invention relates to a process for manufacturing a ski, or like board for gliding over snow, which comprises, on the surface, embedded elements constituted by elements of additional protecting and decorative layers, these elements being flush with the surface of the ski.

According to the invention, the protecting and decorative sheet is laid flat, before being placed in the mould, and the thin elements to be embedded are added thereon by bonding. The assembly of the ski elements is then moulded conventionally, with the result that the inner, uniformly smooth surface of the lid of the mould presses on the additional elements and consequently embeds them in the protecting and decorative sheet.

6 Claims, 3 Drawing Sheets

PROCESS FOR MANUFACTURING A SKI OR LIKE BOARD FOR GLIDING OVER SNOW

FIELD OF THE INVENTION

The present invention relates to a process for making a ski or other board for gliding over snow, such as a snow-surf or monoski, comprising an upper envelope made of plastics material.

BACKGROUND OF THE INVENTION

Documents FR-A-2 702 668 and FR-A-2 740 981 can be cited as state of the art. They disclose processes of manufacture which enable a decorated ski to be obtained. To that end, it is necessary, before the operation of moulding of the ski, to carry out relatively expensive cutout operations in at least one layer constituting the structure of the ski.

It is an object of the invention to obtain a ski, or other board for gliding over snow, which comprises, on the surface, embedded elements which are constituted by elements of additional layers, these elements being of reduced dimensions, and the corresponding process being particularly simple and therefore inexpensive.

SUMMARY OF THE INVENTION

This object is attained, according to the invention, by a process for making a ski or the like, comprising an outer upper envelope made of plastics material covering at least one fibrous and/or metallic reinforcing layer, alone or superposed, characterized in that it consists:

- before the operation of moulding this ski, in pre-bonding on the plastics sheet which is intended to constitute said outer envelope, at least one localized additional sheet,
- in using a mould with an inner surface which is recess- and boss-free at the level of said localized additional sheet(s),
- in embedding said additional sheet(s) in the assembly constituted by the outer plastics envelope and the reinforcing layer, during moulding of said ski, without it having been necessary to that end to form corresponding recesses in elements of the stack forming the structure of the ski.

BRIEF DESCRIPTION OF THE DRAWINGS

The invention will be more readily understood on reading the following description of a non-limiting embodiment thereof, with reference to the accompanying drawings, in which.

DESCRIPTION OF PREFERRED EMBODIMENT

Figure 1:
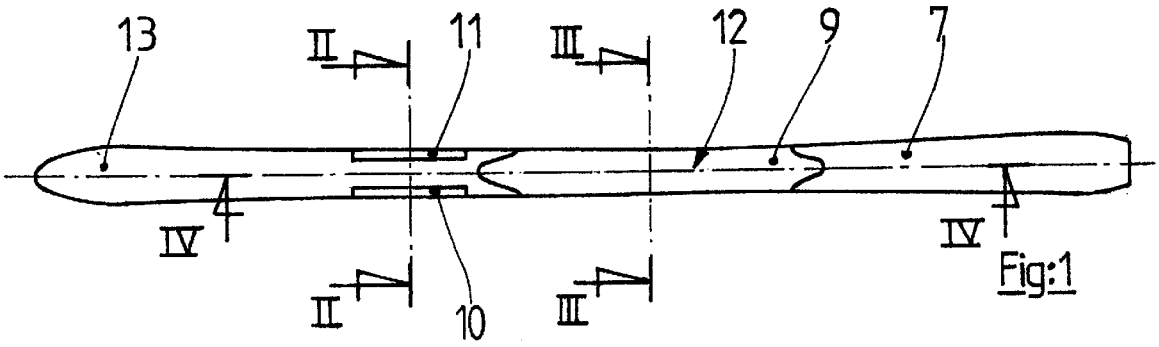
FIG. 1 is a plan view of a ski made by the process according to the invention.
Figure 2:
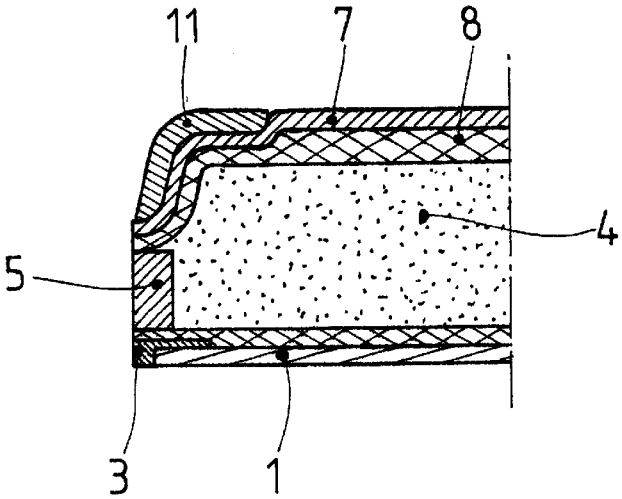
FIG. 2 is a demi-cross section of this ski along line II—II of FIG. 1.
Figure 3:
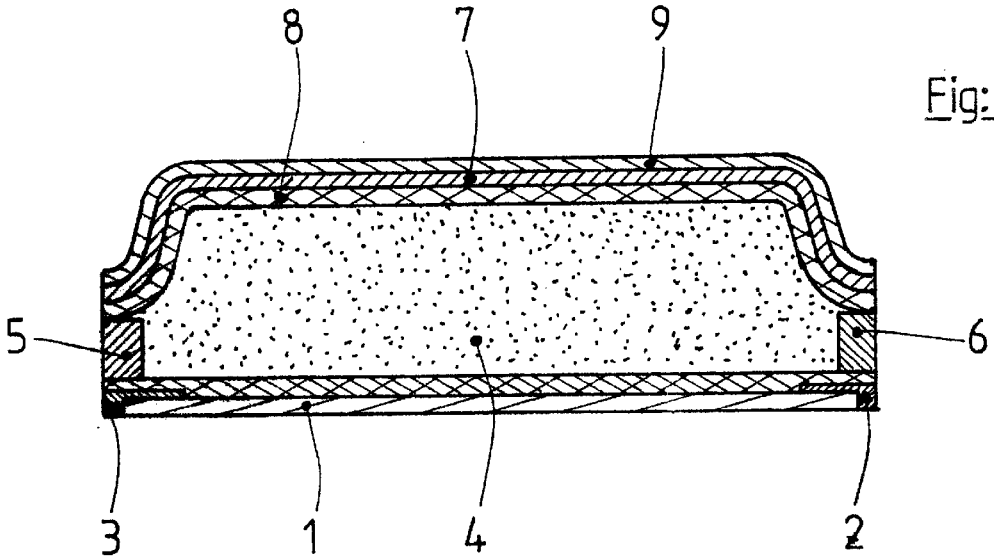
FIG. 3 is a median cross section of this same ski, along line III—III of FIG. 1.

Referring now to the drawings, and firstly to FIGS. 1 to 4 and 7, it is question of a ski incorporating a synthetic core and of "DUALTEC" ® type.

This ski conventionally comprises:

- a lower sole I for slide bordered by lateral metallic edges 2, 3 and surmounted by a reinforcing layer 23, for example constituted by a textile lap;
- a core 4 made of polyurethane, obtained by injection;
- lateral reinforcing sidewalls 5, 6 on either side of the core 4;
- an upper plastics layer 7 for protection and decoration, internally lined with a reinforcing fabric 8, for example constituted by a textile lap, and which rests laterally on the sidewalls 5 and 6; the thickness of the plastics layer 7 is at least equal to 0.6 millimeter; the thickness of the reinforcing fabric 8 is of the order of 1 millimeter.

In accordance with the present embodiment of the invention, the surface of the ski receives three additional, localized elements, formed by plates of reduced dimensions and of small thickness, of the order of 0.5 to 1 millimeter for example, which are embedded in the layers covering the core 4, namely : the upper plastics layer 7 and the textile reinforcing lap 8:

- a central plate 9 which is provided, on the upper face of the ski, in the binding mounting area 12;
- two lateral plates 10, 11 of elongated shape, which are provided, over a limited length and on the two respective lateral sidewalls of the ski, in the area included between the binding mounting area 12 and the front tip 13.

Figure 4:
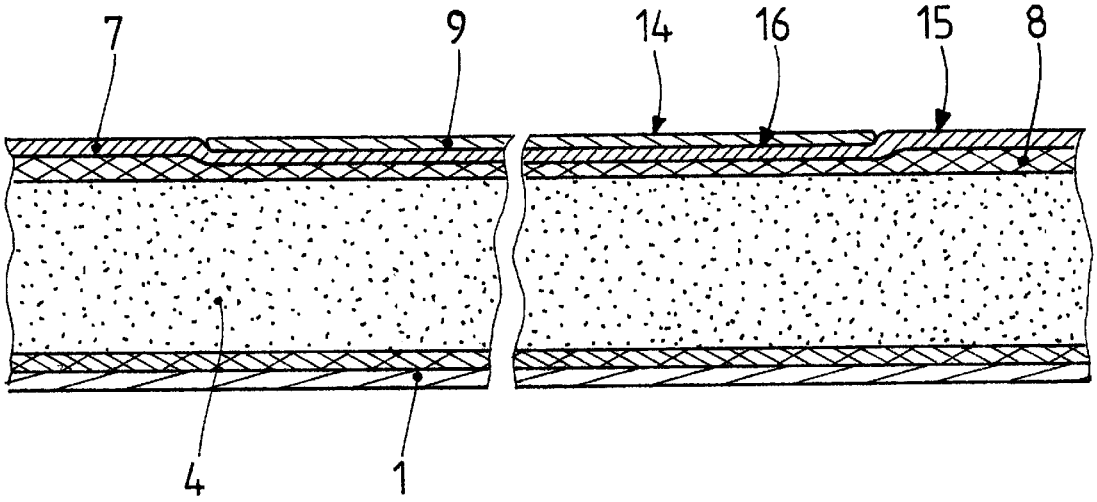
FIG. 4 is a partial median longitudinal section of this same ski, made along line IV—IV of FIG. 1.

As is clearly seen in FIG. 4, these plates, here the central plate 9, are embedded in the plastics protecting and decorative layer 7 and its fibrous reinforcing lap 8, which consequently each present a compression forming a recess corresponding to these spots. Compression of these two layers 7, 8 is obtained under the effect of the pressure of closure of the mould 21, 22 (FIG. 7) so that their upper face 14 arrives substantially flush with the upper surface 15 of the plastics layer 7.

The process according to the invention makes it possible to obtain products comprising elements inlayed in the assembly constituted by the protecting sheet and the reinforcing layer without it being necessary to make cutouts in this assembly or a recess in the rigid core. In effect, a cut-out localized in the core might provoke a longitudinal rupture of the fibers constituting the textile reinforcement adjacent this core, which would be detrimental to the characteristics of resistance of the ski.

It is important that the glass, carbon or kevlar ® fibers constituting this textile layer conserve a good longitudinal surface evenness in order to perform a correct function of reinforcement.

The elements are therefore inlayed, during the moulding operation, by embedding relatively flexible plates between the bottom of the lid of the mould and the rigid core by compressing the intermediate walls constituted by the protecting layer 7 and the textile reinforcing layer 8 pre-impregnated with resin.

It should be noted that the same mould 21, 22 enables models of skis, with or without additional plates 9, 10, 11, to be obtained, the lid 22 of the mould not comprising a recess.

The process of manufacture which enables the ski which has just been described to be produced, will now be explained with particular reference to FIG. 5.

For manufacturing this ski, an outer plastics sheet 7 will firstly be chosen, whose thickness is at least equal to 0.6 millimeter, and preferably 1 millimeter.

Figure 5:
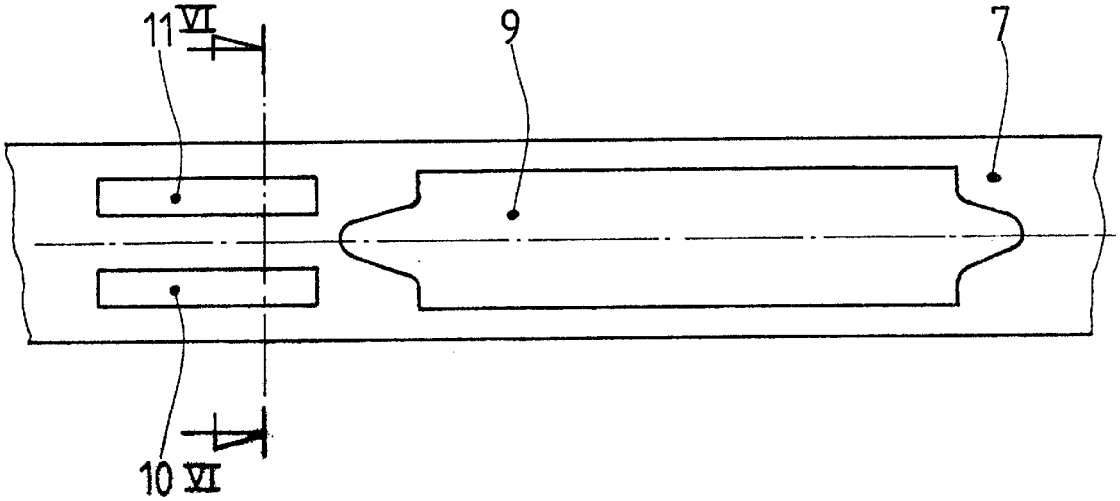
FIG. 5 shows, in order to illustrate the process for producing the ski according to FIGS. 1 to 4, the upper protecting and decorative sheet thereof placed flat before the operation of moulding and comprising the additional elements of the invention.
Figure 6:
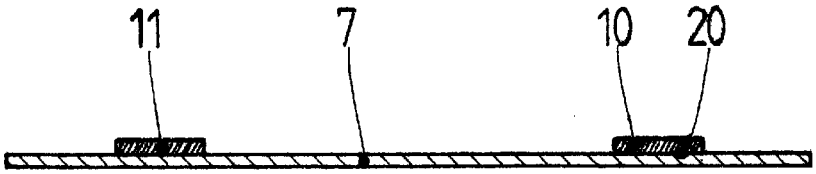
FIG. 6 is a view in section along line VI—VI of FIG. 5.

According to FIG. 5, the additional plates 9, 10, 11, cut out for example from a fine metallic foil, or a fine sheet of polyethylene, or a material presenting damping properties, are added flat, for example by adhesion, at the desired spots on this plastics sheet 7, itself placed flat.

Figure 7:
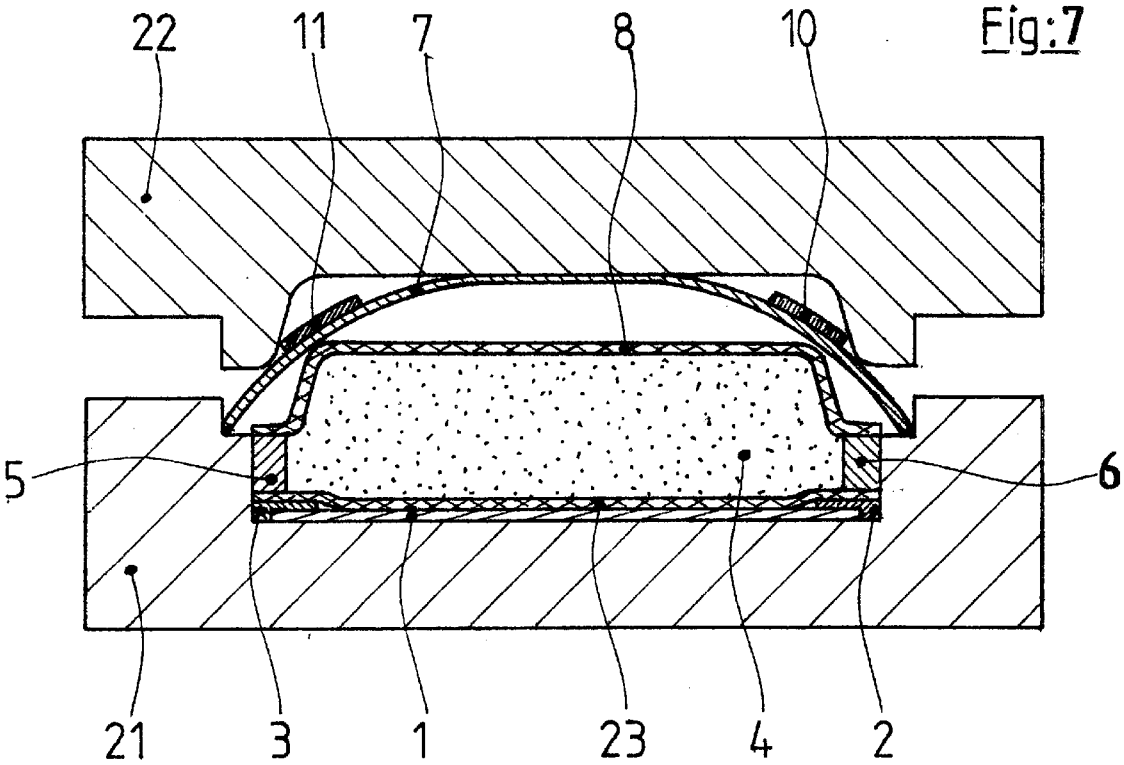
FIG. 7 shows, in cross section along line II—II of FIG. 1, the elements constituting the ski when they are in place in the mould just before the latter is closed.

The assembly is then conventionally placed in the bottom of mould 21, above all the elements of the ski, as shown in FIG. 7.

FIG. 7 illustrates a so-called traditional operation of moulding, consisting in positioning in the bottom of mould 21 the pre-sized elements of the structure of the board, namely:

the lower sole 1 and the edges 2, 3 the lower reinforcing fabric 23 the hard core 4 the sidewalls 5, 6 the upper reinforcing fabric 8 the outer decorative sheet 7 coated with said localized additional elements 9, 10, 11, then in closing the mould by its lid 22.

Hot treatment under pressure of the different resins bonds all the elements constituting the ski in position. Consequently, the layers 8 and 7, with elements 9, 10, 11 which cover them, are applied very strongly—and hot—against the internal, uniformly smooth face of the mould lid. Layers 7 and 8 are then compressed, as in FIG. 4, to leave room, in a recess 16 of conjugate shape, for each of the additional elements such as element 9, these elements then being flush with the layer 7, with the result that, after cooling and removal from the mould, the different layers conserve the state that they acquired in the mould. A finished ski is then obtained, of the same type as described hereinabove with reference to FIGS. 1 to 4, i.e. a ski where the additional elements 9 to 11, typically for protection and/or decoration, are embedded in the upper surface of the ski so as to be virtually flush with this surface.

Typically, the localized additional elements 9 to 11 may be metallic, of thickness typically included between 0.05 and 0.2 millimeter, of plastics material, of thickness typically included between 0.2 and 1 millimeter, or of elastic or visco-elastic material, of thickness typically included between 0.5 and 3 millimeters.

It goes without saying that the invention is not limited to the embodiment which has just been described. The additional plates 9–11 might be composed of a plurality of either superposed or juxtaposed materials. An intermediate layer, typically made of rubbery or visco-elastic material (or other supple material presenting properties of damping), might be interposed between the additional elements 9 to 11 (or certain of them) and the upper plastics layer 8 of the ski.

It should be noted that, if the additional plates are made of elastic material, rubber for example, there will be partial embedding of these plates, during the moulding operation, then, after removal from the mould, decompression of these elastic plates which will then, finally, be slightly in relief with respect to the surface of the decorative sheet, and not flush therewith as in the embodiment described hereinabove and shown in the drawings.

What is claimed is:

1. A process for making a ski or board for gliding over snow, comprising an outer upper envelope made of plastic materials covering at least one internal reinforcing layer, wherein it comprises the following steps of:

before the operation of moulding said ski, pre-bonding on an upper plastic sheet which is intended to constitute said outer upper envelope at least one localized additional sheet which is received at an upper surface of said ski, using a mould with an inner surface which has no localized recesses or bosses to accommodate said at least one localized additional sheet, inlaying said localized additional sheet by compressing an assembly constituted by the outer upper envelope and the at least one internal reinforcing layer during moulding of said ski to leave room in a recess of conjugate shape for said localized additional sheet, said localized additional sheet then being flush with the outer upper envelope.

2. The process of claim 1, wherein a protecting and decorative sheet of said ski presents a thickness of at least equal to 0.6 millimeters.

3. The process of claim 1, wherein a metallic material is chosen for said localized additional sheet.

4. The process of claim 1, wherein a plastic material is chosen for said localized additional sheet.

5. The process of claim 1, wherein a visco-elastic material is chosen for said localized additional sheet.

6. The process of claim 1, wherein an elastic material is chosen for said localized additional sheet.

* * * * *